US007326839B2

(12) United States Patent
Kinoshita

(10) Patent No.: US 7,326,839 B2
(45) Date of Patent: Feb. 5, 2008

(54) STRINGED INSTRUMENT BRIDGE AND STRINGED INSTRUMENT

(75) Inventor: Osamu Kinoshita, Nagoya (JP)

(73) Assignee: Hoshino Gakki Co, Ltd. (JP)

( * ) Notice: Subject to any disclaimer, the term of this patent is extended or adjusted under 35 U.S.C. 154(b) by 196 days.

(21) Appl. No.: 11/326,220

(22) Filed: Jan. 5, 2006

(65) Prior Publication Data

US 2006/0162528 A1 Jul. 27, 2006

(30) Foreign Application Priority Data

Jan. 21, 2005 (JP) ..... 2005-014361
Aug. 2, 2005 (JP) ..... 2005-224278

(51) Int. Cl.
*G10D 3/04* (2006.01)

(52) U.S. Cl. ..... 84/298; 84/299

(58) Field of Classification Search ..... 84/298, 84/299

See application file for complete search history.

(56) References Cited

U.S. PATENT DOCUMENTS 2,918,837 A * 12/1959 Webster ..... 84/312 R
3,290,980 A * 12/1966 Fender ..... 84/307
4,248,126 A 2/1981 Lieber ..... 84/299
4,361,068 A 11/1982 Schaller ..... 84/299
4,742,750 A * 5/1988 Storey ..... 84/313
7,071,398 B2 * 7/2006 Hannes ..... 84/319
2006/0162528 A1 * 7/2006 Kinoshita ..... 84/298

FOREIGN PATENT DOCUMENTS

JP 57-124796 8/1982
JP 8185157 7/1996

OTHER PUBLICATIONS

Japanese Office Action dated Apr. 24, 2007.

* cited by examiner

*Primary Examiner*—Lincoln Donovan
*Assistant Examiner*—Robert W. Horn
(74) *Attorney, Agent, or Firm*—Ostrolenk, Faber, Gerb & Soffen, LLP

(57) ABSTRACT

A stringed instrument bridge arrangeable on a body of a bass guitar. The bridge includes a plurality of saddle units, each corresponding to a string. Each saddle unit includes a base plate, a unit base, and a saddle. A screw pivotally supports the unit base on the base plate. The unit base is pivoted to move a contact point at which the saddle contacts the corresponding string.

17 Claims, 10 Drawing Sheets

STRINGED INSTRUMENT BRIDGE AND STRINGED INSTRUMENT

BACKGROUND OF THE INVENTION

The present invention relates to a stringed instrument and a stringed instrument bridge enabling adjustment of the distance between strings.

An electric guitar includes a body and a neck. Further, an electric guitar includes a head, which is located at a distal end of the neck, and strings, which extend along the surface of the neck. Each string is fixed to the body by a tailpiece and to the neck by a peg. A nut supports each string on the neck near the pegs. A bridge is arranged on the body near the tailpiece to support the strings. The nut supports the strings with the bridge so as to enable vibration of the strings. In such an electric guitar, the guitar is tuned by changing the winding position of each string relative to the associated peg and adjusting the tension applied to the string. There has been a recent proposal for a bridge that enables adjustment of the distance between the strings and the neck (height of the strings) and the distance between the nut and the bridge (length of the strings). Further, U.S. Pat. No. 4,248,126 describes a bridge enabling adjustment of the distance between the strings.

In U.S. Pat. No. 4,248,126, referring to FIG. 14, a first slide piece 103 and a second slide piece 104 are arranged on a bridge base 101. The first slide piece 103 is supported on the bridge base 101 so that the position of the first slide piece 103 is adjustable in the longitudinal direction of the string 102. A projection 103*a* extends from the upper surface of the first slide piece 103 in a direction orthogonal to the string 102. The second slide piece 104 is movably supported on the projection 103*a* of the first slide piece 103. The second slide piece 104 has a vertex, which is the point of contact with the string 102. The second slide piece 104 is fastened to the first slide piece 103 by a screw 105. The screw 105 is loosened to enable adjustment of the position of the second slide piece 104. By changing the position of the second slide piece 104 in a state supporting the string 102, the distance between the string 102 and an adjacent string 102 is adjusted. The screw 105 is tightened to fix the second slide piece 104. This prevents abnormal noise from being produced when the electric guitar is played.

Normally, in a guitar having six strings, the distance between adjacent strings 102 is approximately 10 mm. In a bass guitar having four strings, the distance between adjacent strings 102 is approximately 15 to 20 mm. When adjusting the distance between adjacent strings 102 with the stringed instrument bridge described in the above patent, a tool must be inserted into the narrow space between the string 102 and the bridge base 101 to loosen or tighten the screw 105. This makes it difficult to adjust the distance between adjacent strings 102.

SUMMARY OF THE INVENTION

It is an object of the present invention to provide a stringed instrument bridge and a stringed instrument that facilitate the adjustment of the distance between strings.

One aspect of the present invention is a stringed instrument bridge for supporting, on a body of a stringed instrument, a plurality of strings in a manner enabling vibration of the strings. The stringed instrument bridge includes a plurality of unit bases arrangeable on the body, each unit base corresponding to one of the strings. A saddle is arranged on each unit base and has a contact point for contacting the string. A support shaft pivotally supports each unit base on the body. The unit base is pivoted about the support shaft to move the contact point in a direction intersecting the corresponding string.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

A stringed instrument bridge according to a first embodiment of the present invention and applied to a bass guitar will now be described with reference to FIGS. 1 to 5. In the description of the stringed instrument bridge, the forward, leftward, rightward, and upward directions are as indicated in FIGS. 1 to 5.

Figure 1:
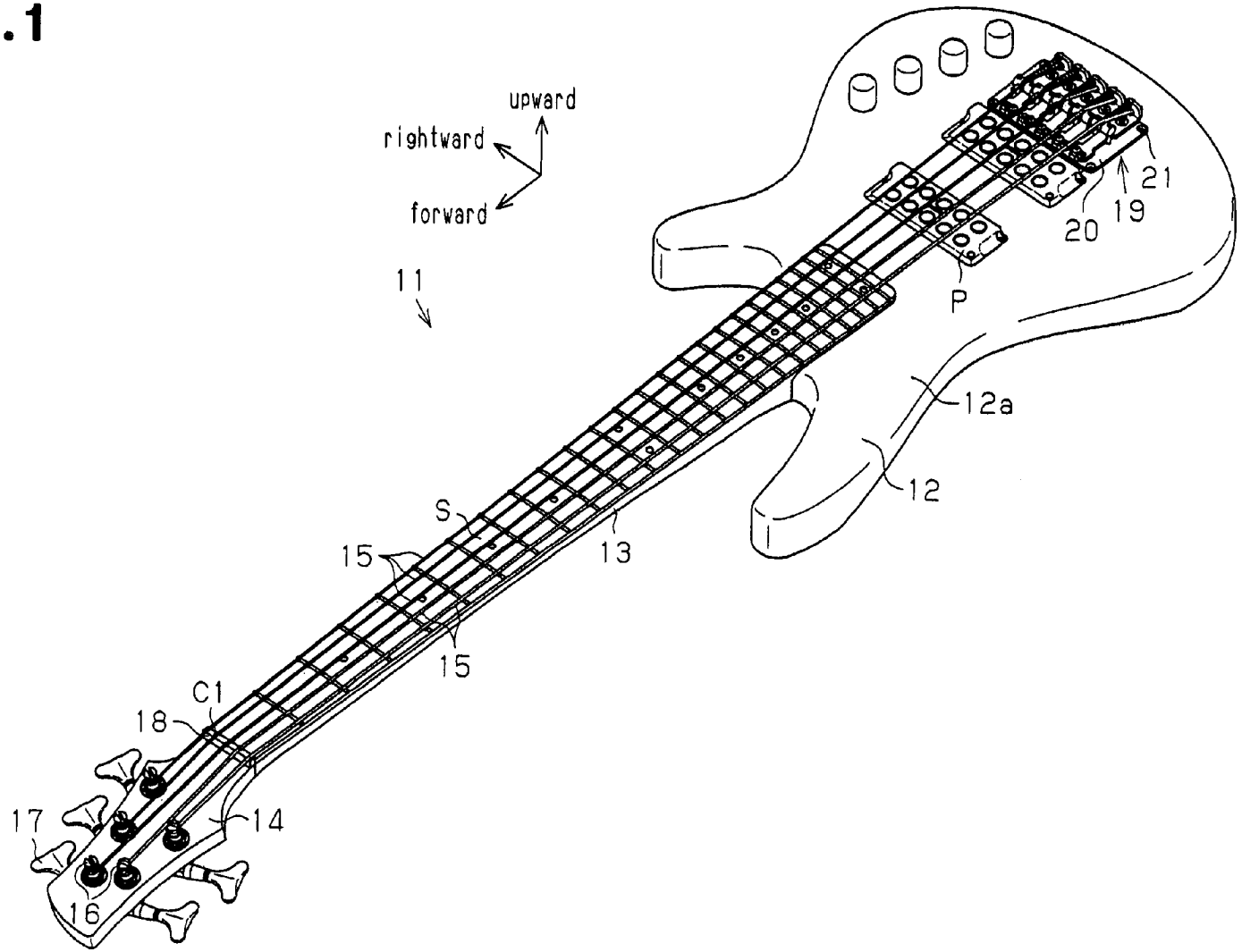
FIG. 1 is a perspective view showing a bass guitar according to a first embodiment of the present invention.

Referring to FIG. 1, the bass guitar 11 includes a body 12, a neck 13 extending forward from the body 12, and five strings 15. The neck 13 has a distal end on which a head 14 is formed. The head 14 includes winding portions 16, a gear mechanism (not shown), and pegs 17. Each peg 17 is turned to adjust the tension applied to a corresponding one of the strings 15. A nut 18 is arranged on the distal end of the neck 13. The nut 18 has an upper surface including contact points C1 where the nut 18 contacts the strings 15. A bridge 19 is arranged on an upper surface 12*a* of the body 12.

Figure 2:
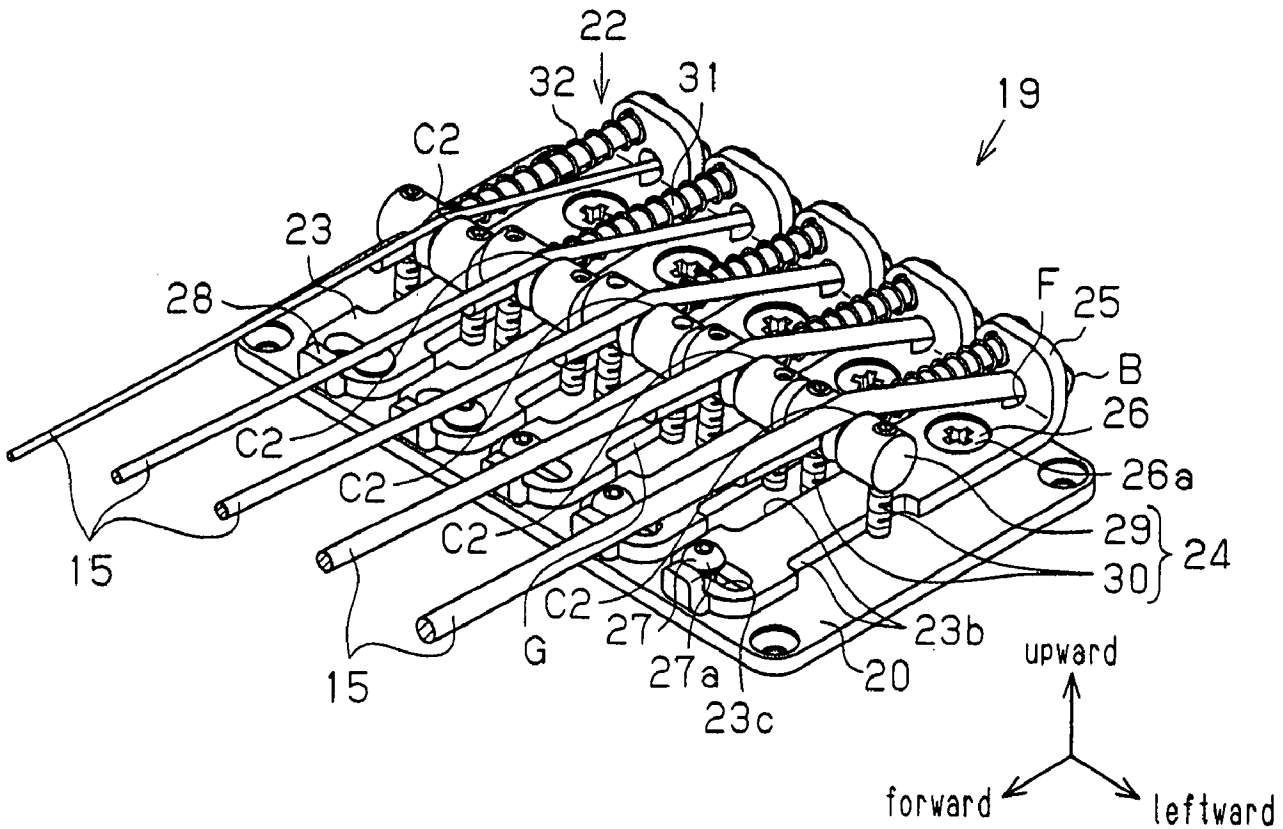
FIG. 2 is a perspective view showing a stringed instrument bridge of the first embodiment.
Figure 3:
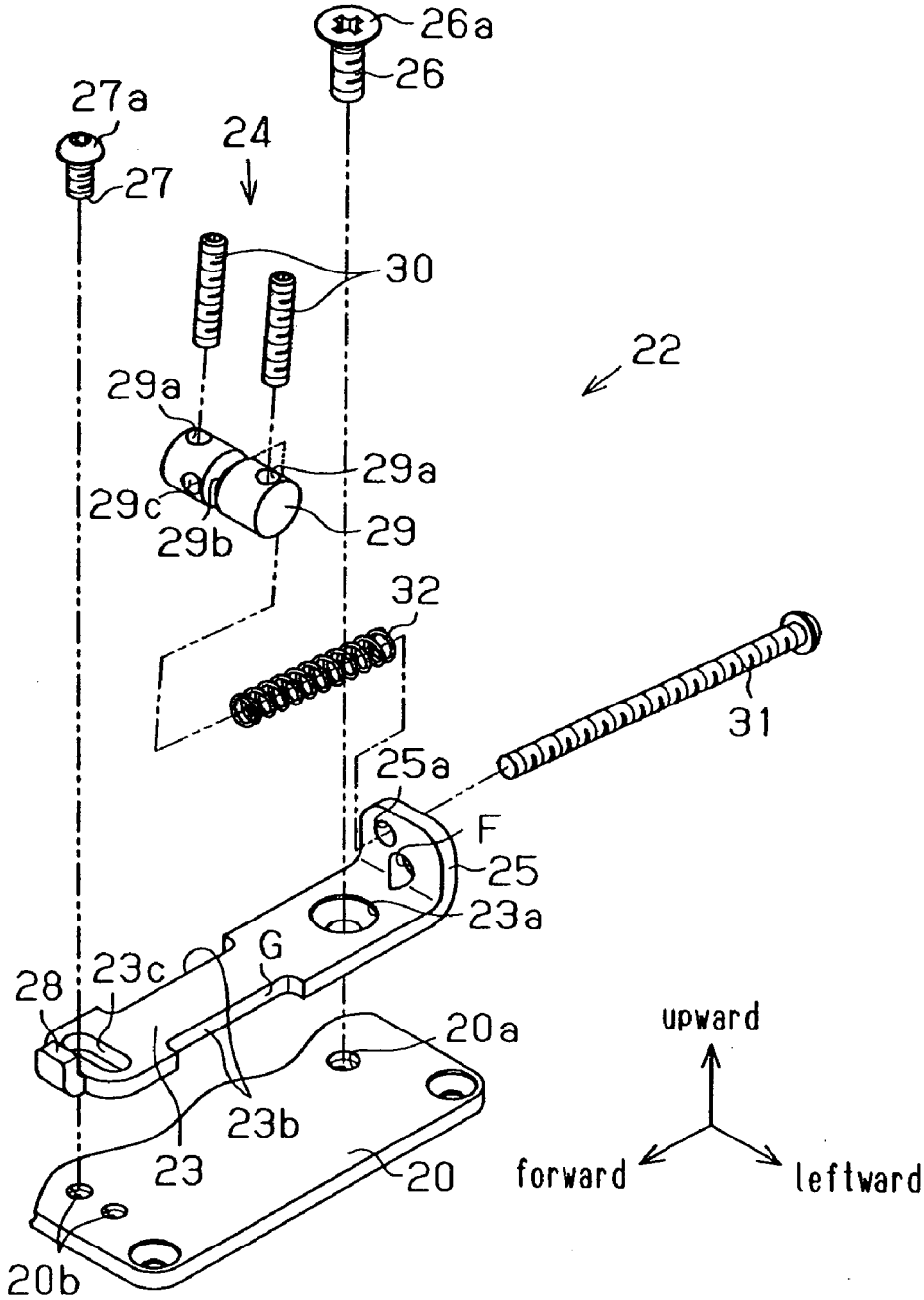
FIG. 3 is an exploded perspective view showing the stringed instrument bridge of the first embodiment.
Figure 4:
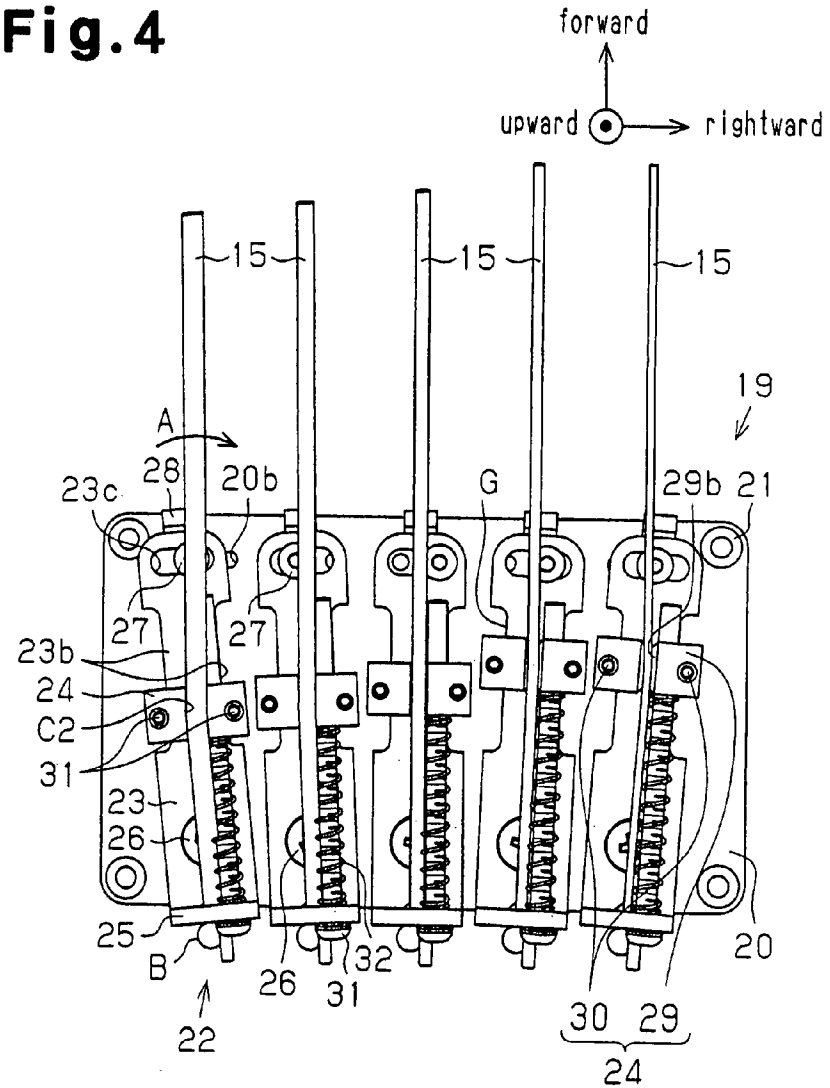
FIG. 4 is a plan view showing the stringed instrument bridge of the first embodiment in a state before adjusting the distance between strings.

Referring to FIGS. 2 to 4, the bridge 19 includes a rectangular base plate 20. The base plate 20 is fixed to the body 12 by four screws 21. Five saddle units 22, each corresponding to one of the strings 15, are arranged on the base plate 20. Each saddle unit 22 includes a unit base 23 and a saddle 24. Each unit base 23 is fixed on the base plate 20 by a first screw 26, and each saddle 24 is fixed on the corresponding unit base 23 by a second screw 27. The base plate 20 and the unit bases 23 are made of metal such as steel.

Each unit base 23 is formed by pressing a metal plate that has been stamped into a predetermined shape. The unit base 23 includes a tailpiece 25, which functions as a string holder. The tailpiece 25 is formed by upwardly bending the rear end portion of the unit base 23. The tailpiece 25 includes a holding hole F for holding the rear end of the corresponding string 15. The string 15 is inserted into the holding hole F from the rear toward the front. A ball end B is attached to the rear end of the string 15. The string 15 is held by the tailpiece 25 in a state in which the ball end B engages with the wall around the holding hole F.

An insertion hole 23*a* is formed near the rear end of each unit base 23 to fasten the unit base 23 to the base plate 20. The first screw 26 is a flathead screw. The diameter of the insertion hole 23*a* is gradually reduced in the downward direction so as to correspond with the shape of the head 26*a* of the first screw 26. The base plate 20 includes a threaded hole 20*a* corresponding to the insertion hole 23*a*. The first screw 26 is inserted through the insertion hole 23*a* of the unit base 23 and mated with the threaded hole 20*a* of the base plate 20. When the first screw 26 is mated with the threaded hole 20*a*, the head 26*a* of the first screw 26 is in contact with the wall of the insertion hole 23*a*. A cutaway portion 23*b* (guide) is formed on each of the two sides of the unit base 23.

An elongated hole 23*c* extending in the lateral direction is formed near the front end of the unit base 23. The elongated hole 23*c* extends along an arc of which the center is the first screw 26. The base plate 20 includes two threaded holes 20*b* corresponding to the elongated hole 23*c*. The corresponding second screw 27 is inserted through the elongated hole 23*c* and mated with either one of the threaded holes 20*b* in the base plate 20.

The second screw 27 is loosened to enable the unit base 23 to be pivoted about the first screw 26 within a range in which the second screw 27 engages with the two ends of the elongated hole 23*c*. Further, the pivotal range of the unit base 23 may be varied by mating the second screw 27 with the other one of the threaded holes 20*b*. When the second screw 27 is tightened, the head 27*a* of the second screw 27 forces the periphery of the elongated hole 23*c* in a downward direction. The downward force fastens the front end portion of the unit base 23 to the base plate 20. In this embodiment, the second screw 27 functions as a fastener for fastening the unit base 23 to the base plate 20.

A tab 28 is formed on the front end portion of the unit base 23. The tab 28 is formed by upwardly bending the front end portion of the unit base 23. A person may hold the tab 28 with his or her fingers to move the unit base 23 to the left and to the right in order to pivot the unit base 23.

The saddle 24 includes a saddle body 29 and two support rods 30. A male threaded portion is defined on the peripheral surface of each support rod 30. The saddle body 29 is generally cylindrical and includes two threaded holes 29*a* formed on opposite sides of the saddle body 29. Each support rod 30 is mated with one of the threaded holes 29*a*. The support rods 30 project downward out of the corresponding threaded holes 29*a* so that the projected portions of the support rods 30 are arranged in the two cutaway portions 23*b* of the unit base 23. In this manner, two side surfaces G of the unit base 23 are held between the two support rods 30. This restricts movement of the saddle 24 in the lateral direction. The two support rods 30 support the saddle body 29 movably in the longitudinal direction of the corresponding string 15 with respect to the base plate 20.

The saddle body 29 includes a middle portion defining a small diameter portion 29*b*. The small diameter portion 29*b* of the saddle body 29 includes a contact point C2, at which the saddle body 29 contacts the corresponding string 15. In other words, the small diameter portion 29*b* of the saddle body 29 supports the string 15. Further, the saddle body 29 includes a threaded hole 29*c* near the small diameter portion 29*b*. The threaded hole 29*c* extends in a direction orthogonal to the threaded holes 29*a*. The corresponding tailpiece 25 includes a through hole 25*a* corresponding to the threaded hole 29*c*. An adjustment screw 31 is inserted from the rear through the through hole 25*a* of the tailpiece 25 and mated with the threaded hole 29*c* of the saddle body 29. This arranges the adjustment screw 31 parallel to the corresponding string 15. The mated amount of the adjustment screw 31 is varied to change the position of the saddle 24 in the longitudinal direction of the string 15. Further, the adjustment screw 31 restricts the movement of the saddle 24 in the lateral direction and holds the saddle body 29 substantially orthogonal to the unit base 23.

A compression coil spring 32 is arranged on the adjustment screw 31. The compression coil spring 32 has a rear end that contacts the tailpiece 25 and a front end that contacts the saddle body 29. That is, the compression coil spring 32 is arranged between the saddle body 29 and the tailpiece 25. Thus, the saddle 24 is urged to the front by the compression coil spring 32.

Each string 15 has a front end fixed to the corresponding winding portion 16 and a rear end fixed to the corresponding tailpiece 25. Between the winding portion 16 and the tailpiece 25, the string 15 is supported by the upper surface of the nut 18 and the small diameter portion 29*b* of the corresponding saddle body 29. Accordingly, a contact point between the nut 18 and the string 15 (first contact point C1) is defined on the upper surface of the nut 18, and a contact point between the saddle body 29 and the string 15 (second contact point C2) is defined on the small diameter portion 29*b* of the saddle body 29. The strings 15 extend parallel to one another between the associated first and second contact points C1 and C2.

In each saddle 24, the support rods 30 are turned to move the saddle body 29 towards and away from the unit base 23. In this manner, the contact point C2 of the saddle 24 is raised or lowered to adjust the height of each string 15. Further, the adjustment screw 31 is turned to move the saddle body 29 along the cutaway portions 23*b* of the unit base 23. This adjusts the length of the string 15 between the two contact points C1 and C2 while keeping the saddle body 29 orthogonal to the base plate 20 and maintaining the vertical position of the contact point C2 between the saddle body 29 and the string 15. In this embodiment, the saddle 24 is arranged forward from the first screw 26. Further, the distance between the first screw 26 and the saddle 24 is shorter than the distance between the first screw 26 and the second screw 27.

Figure 5:
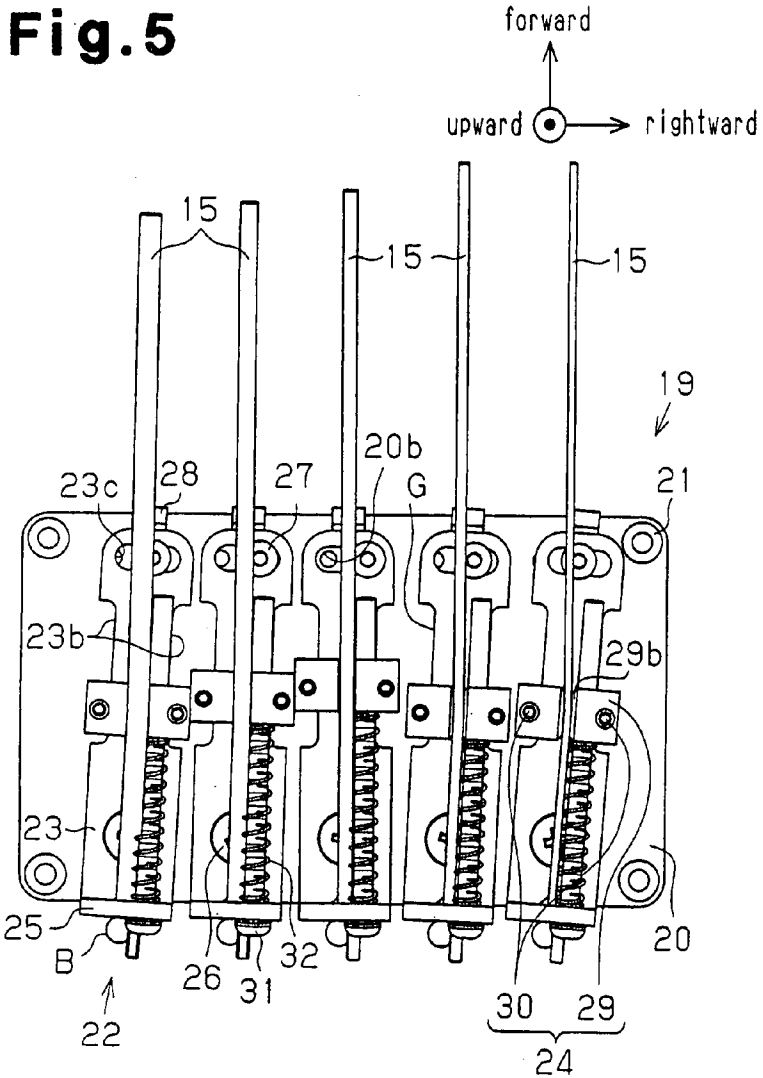
FIG. 5 is a plan view showing the stringed instrument bridge of the first embodiment in a state after adjusting the distance between strings.

The operation of the bridge 19 will now be discussed with reference to FIGS. 4 and 5. An example in which the unit base 23 corresponding to the fifth string (i.e., the leftmost string 15 as viewed in FIG. 4) of the bass guitar 11 is pivoted will be described.

First, the first and second screws 26 and 27 are loosened to enable pivoting of the unit base 23 relative to the base plate 20. The tab 28 is held with the fingers to move the unit base 23 to the right (in direction A as indicated in FIG. 4). In this state, the saddle 24 is supported by the two support rods 30 and the adjustment screw 31 on the unit base 23. Thus, the second contact point C2 of the saddle 24 moves in direction A so as to follow the movement of the unit base 23. This moves the string 15 against its elastic reaction force in direction A. Subsequently, the lateral position of the unit base 23 is finely adjusted in a state in which the second screw 27 is mated with the threaded hole 20*b*. After arranging the second contact point C2 at the desired position, the second screw 27 is tightened to fasten the unit base 23 to the base plate 20. This fixes the unit base 23 at the position shown in FIG. 5 and decreases the distance between the string 15 (fifth string) and the adjacent string 15 (fourth string) in comparison to the state shown in FIG. 4. The procedures described above are reversed when increasing the distance between these adjacent strings 15 (fifth string and fourth string).

The first embodiment has the advantages described below.

(1) Each saddle 24 is supported by the two support rods 30 and the adjustment screw 31 on the unit base 23. The two support rods 30 restrict the movement of the saddle 24 in the lateral direction, and the adjustment screw 31 restricts the movement of the saddle 24 in the longitudinal direction of the corresponding string 15. As a result, by loosening the second screw 27 to enable pivoting of the unit base 23, lateral movement of the second contact point C2 of the saddle 24 is enabled. This enables the adjustment of the distance between adjacent strings 15.

(2) The second screw 27 is tightened after moving the second contact point C2 of the saddle 24 to the desired position. As a result, the head 27*a* of the second screw 27 applies force to the periphery of the elongated hole 23*c* and fixes the unit base 23 to the base plate 20. This prevents rattling of the saddle 24. Thus, abnormal noise is not produced when playing the bass guitar 11, and sufficient sustain may be produced. Further, the second screw 27 is arranged orthogonal to the body 12. This arrangement enables the second screw 27 to be loosened and tightened with a tool even when the string 15 is currently strung. Accordingly, the adjustment of the distance between adjacent strings 15 is facilitated.

(3) The second screw 27 is arranged forward from the corresponding saddle 24. Thus, the distance between the first screw 26 and the second screw 27 is longer than the distance between the first screw 26 and the saddle 24. In this case, with regard to the principle of a lever, the distance between the first screw 26 (fulcrum) and the second screw 27 (point of force) is longer than the distance between the first screw 26 (fulcrum) and the saddle 24 (point of action). This ensures that the unit base 23 is fixed to the base plate 20 against the force applied to the saddle 24 by the string 15.

(4) The saddle 24 is located forward from the first screw 26. This reduces the dimensions of the entire bridge 19 in comparison with when the saddle 24 is located rearward from the first screw 26.

(5) The second screw 27 and the saddle 24 are both located forward from the first screw 26. This reduces the length of the unit base 23 and enables further miniaturization of the unit base 23.

(6) The tab 28 is formed on the front end portion of each unit base 23. The tab 28 may be held by a person's fingers to move the unit base 23 in the lateral direction. This facilitates the adjustment of the distance between adjacent strings 15.

(7) The tab 28 is located farthest from the first screw 26 in each unit base 23. Thus, the unit base 23 may be moved in the lateral direction with a small force. This further facilitates fine adjustment of the distance between adjacent strings 15.

(8) The tab 28 is located forward from the first screw 26 in each unit base 23. Thus, the amount the saddle 24 is moved is less than the amount the tab 28 is moved. This facilitates the fine adjustment of the contact point C2 of the saddle 24 in comparison with the stringed instrument bridge of the prior art.

(9) When tightening the second screw 27, the head 27*a* of the second screw 27 applies force to the periphery of the elongated hole 23*c*. This force fastens the unit base 23 to the base plate 20. In this case, the second screw 27 is tightened while holding the tab 28 with the fingers when the string 15 is currently strung. This ensures that the unit base 23 and the saddle 24 are fixed at predetermined positions.

(10) Each unit base 23 has the tailpiece 25 for holding the rear end of the corresponding string 15. This reduces the number of components in comparison to when a tailpiece is formed separately from the unit base 23.

(11) The saddle 24 is moved along the cutaway portions 23*b* of the corresponding saddle 24 by turning the adjustment screw 31. In other words, the length of each string 15 is adjusted by moving the saddle 24 in the longitudinal direction of the string 15.

(12) The two support rods 30 are turned to move the saddle body 29 towards and away from the unit base 23. This moves the saddle 24 in the vertical direction and adjusts the height of each string 15.

(13) The small diameter portion 29*b* is formed in the middle portion of each saddle body 29. The contact point C2 between the saddle body 29 and the corresponding string 15 is located on the small diameter portion 29*b*. In this case, even if the saddle 24 is moved in the lateral direction, the string 15 remains on the small diameter portion 29*b* of the saddle body 29. This enables the adjustment of the distance between adjacent strings 15 against the force applied to the saddle 24 by the string 15 even in a state in which the string 15 is currently strung.

(14) The first screw 26 functions as a support shaft for supporting the unit base 23. This simplifies the structure of the stringed instrument bridge 10 in comparison to when the first screw 26 and the support shaft are formed from different members.

(15) The base plate 20 includes the two threaded holes 20*b* corresponding to the elongated hole 23*c* of the unit base 23. This enlarges the pivotal range of the unit base 23 without increasing the width of the unit base 23.

Second Embodiment

A stringed instrument bridge according to a second embodiment of the present invention and applied to an electric guitar will now be described with reference to FIGS. 6 to 9. Like or same reference numerals are given to those components that are the same as the corresponding components of the first embodiment.

Figure 6:
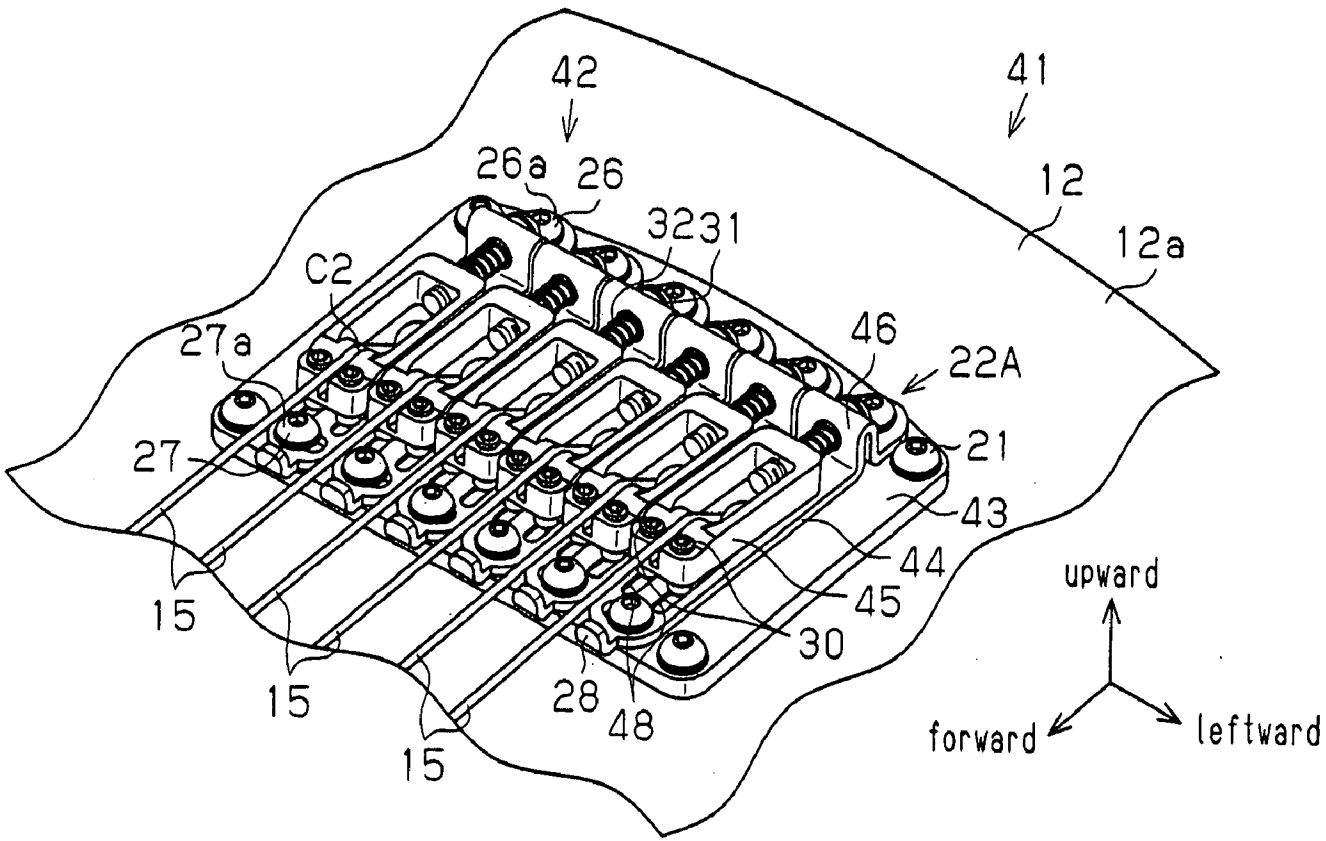
FIG. 6 is a perspective view showing a stringed instrument bridge according to a second embodiment of the present invention.

Referring to FIG. 6, a bridge 42 includes a base plate 43, which is located on the upper surface 12*a* of the body 12. The electric guitar 41 includes six strings 15. Six saddle units 22A, each corresponding to one of the strings 15, are arranged on the base plate 43.

Figure 7:
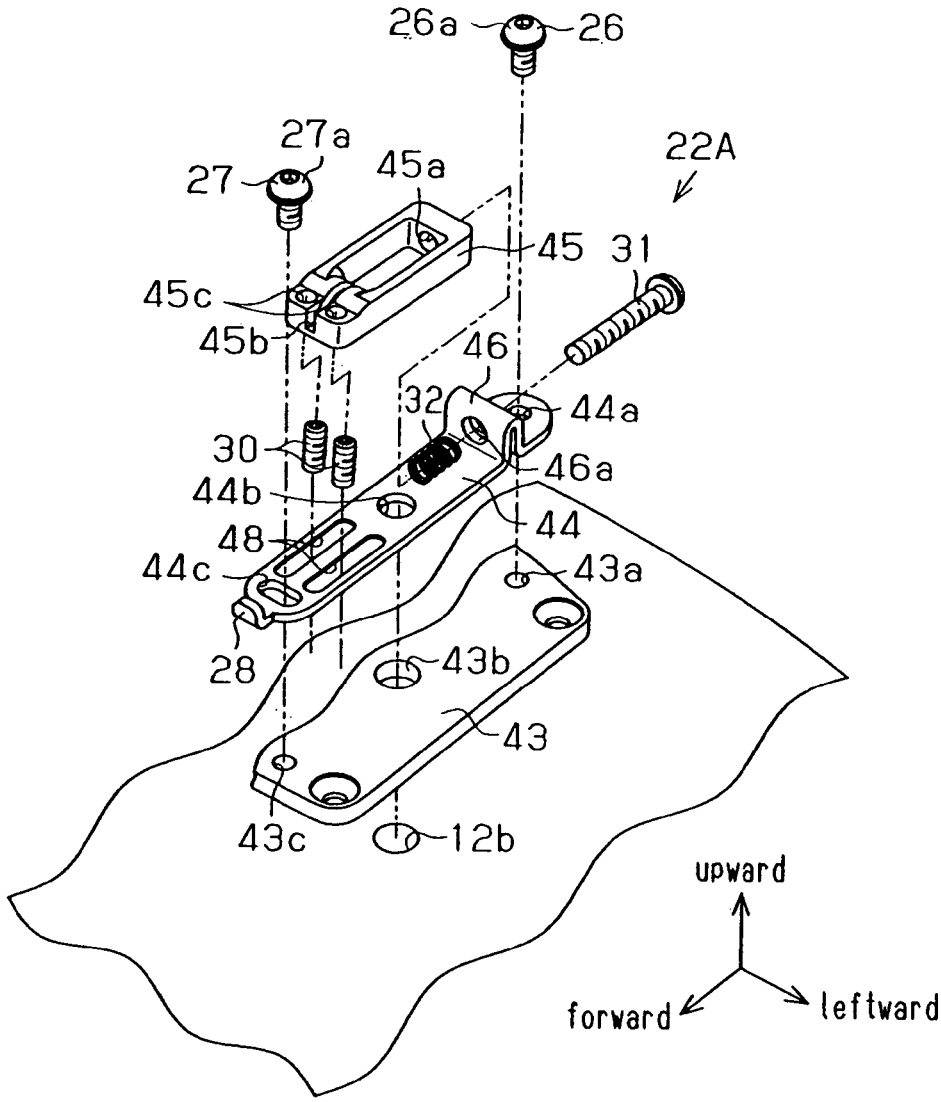
FIG. 7 is an exploded perspective view showing a stringed instrument bridge of the second embodiment.

Referring to FIG. 7, each saddle unit 22A includes a plate-shaped unit base 44 and a saddle 45 arranged on the unit base 44. A through hole 44*a* used to fasten the unit base 44 to the base plate 43 is formed near the rear end of the unit base 44. The base plate 43 includes a threaded hole 43*a* corresponding to the through hole 44*a*. The first screw 26 is inserted through the through hole 44*a* of the unit base 44 and mated with the threaded hole 43*a* of the base plate 43. When the first screw 26 is mated with the threaded hole 43*a*, the head 26*a* of the first screw 26 contacts the upper surface of the unit base 44. Further, the first screw 26 pivotally supports the unit base 44 on the base plate 43.

A projection 46 projects upward from the unit base 44 at a position rearward from the middle of the unit base 44. The projection is formed by bending part of the unit base 44 in a generally U-shaped manner. A through hole 46*a* extends through the middle portion of the projection 46.

A through hole 44*b* is formed in the middle portion of the unit base 44. The base plate 43 and the body 12 respectively include a through hole 43*b* and a through hole 12*b* in correspondence with the through hole 44*b*. A string 15 is inserted from below the through hole 12*b* of the body 12. The string 15 is then extended through the through hole 43*b* of the base plate 43 and the through hole 44*b* of the unit base 44 and guided to the upper surface 12*a* of the body 12. The string 15 has a ball end B that is held by the through hole 12*b* of the body 12.

Two elongated guide holes 48 (guide) are formed extending in the longitudinal direction of the string 15 at a position frontward from the middle of the unit base 44. An elongated hole 44*c*, which extends in the lateral direction, is formed in the unit base 44 in front of the two guide holes 48. The base plate 43 includes a threaded hole 43*c* corresponding to the elongated hole 44*c*. The second screw 27 is inserted through the elongated hole 44*c* of the unit base 44 and mated with the threaded hole 43*c* of the base plate 43. When the second screw 27 is tightened, the head 27*a* of the second screw 27 forces the periphery of the elongated hole 44*c* in a downward direction. The downward force fastens the front portion of the unit base 44 to the base plate 43. In this embodiment, the second screw 27 functions as a fastener for fastening the unit base 44 to the base plate 43.

The saddle 45 has the shape of a rectangular frame extending in the longitudinal direction of the corresponding string 15. The saddle 45 has a front end portion including a recess 45*b*. The recess 45*b* has an arcuate upper surface. A contact point C2 at which the saddle contacts the string 15 is defined on the upper surface of the recess 45*b*. In other words, the rear end portion of the string 15 is supported by the recess 45*b* of the saddle 45.

Two threaded holes 45*c* are formed in the front end portion of the saddle 45 on opposite sides of the recess 45*b*. A support rod 30 is mated with each threaded hole 45*c*. Each support rod 30 partially projects downward from the threaded hole 45*c* of the saddle 45. The projected portion of the support rod 30 is fitted into an associated one of the guide holes 48. The two support rods 30 are fitted into the guide holes 48 to restrict lateral movement of the saddle 45. The two support rods 30 also support the saddle 45 movably in the longitudinal direction of the string 15 with respect to the base plate 43.

The saddle 45 includes a threaded hole 45*a* corresponding to the through hole 46*a* of the projection 46. An adjustment screw 31 is inserted from the rear into the through hole 46*a* of the projection 46 and mated with the threaded hole 45*a* of the saddle 45. The adjustment screw 31 restricts movement of the saddle 45 in the lateral direction, while holding the saddle generally orthogonal to the unit base 44. Further, the mated amount of the adjustment screw 31 is varied to change the position of the saddle 45 in the longitudinal direction of the string 15. A compression coil spring 32 is arranged in the distal portion of the adjustment screw 31. The compression coil spring 32 urges the saddle 45 to the front.

A socket is formed in the top portion of each support rod 30. A wrench is inserted into the socket to turn the support rod 30 about its axis. This moves the saddle 45 toward and away from the unit base 44. In this manner, the height of the saddle 45 is adjusted to vertically move the contact point C2 of the saddle 45 and adjust the height of the corresponding string 15. Further, the adjustment screw 31 is turned to move the saddle 45 along the guide holes 48. The position of the saddle 45 in the longitudinal direction of the string 15 is adjusted to move the contact point C2 of the saddle 45 toward the front or the rear and adjust the length of the string 15 between the first and second contact points C1 and C2.

Figure 8:
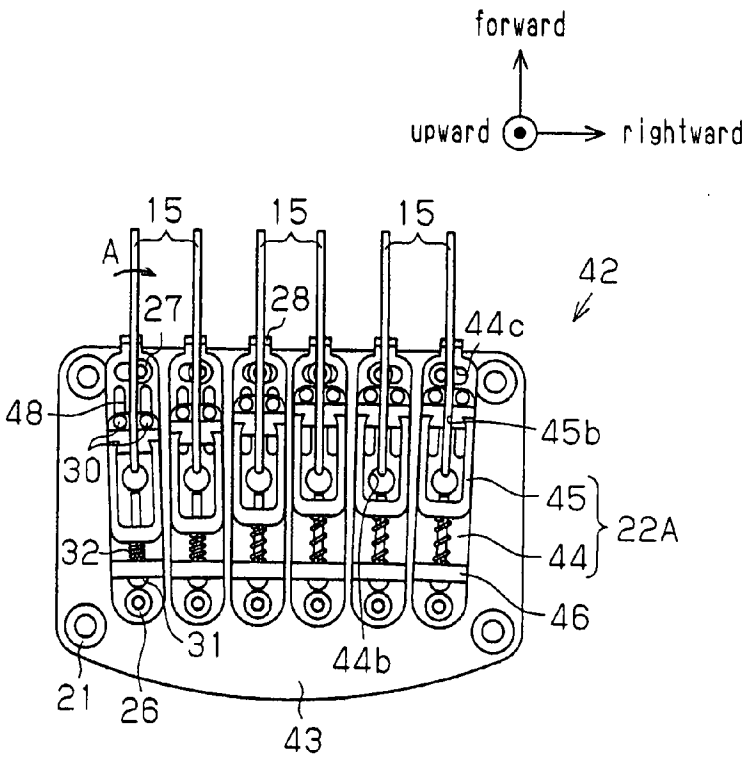
FIG. 8 is a plan view showing the stringed instrument bridge of the second embodiment in a state before adjusting the distance between strings.
Figure 9:
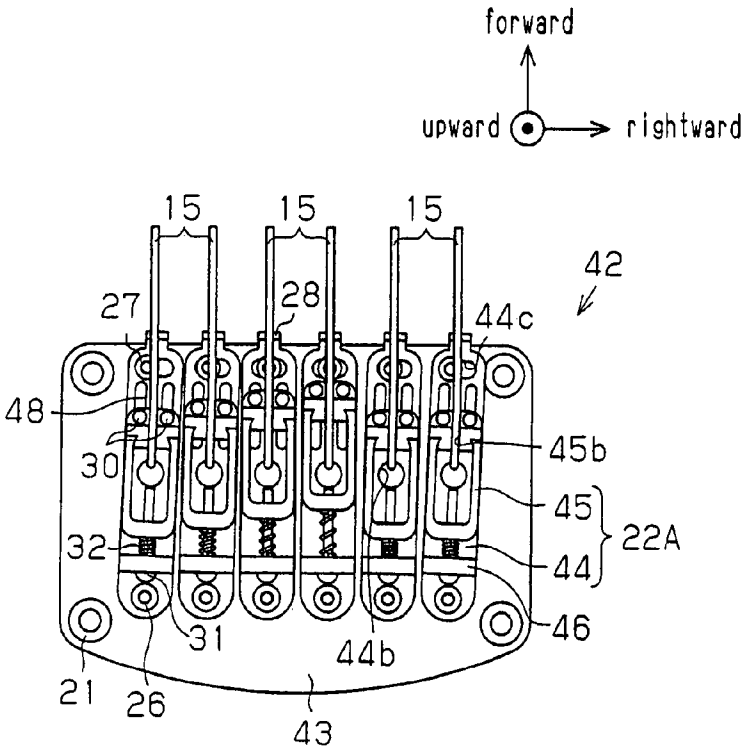
FIG. 9 is a plan view showing the stringed instrument bridge of the second embodiment in a state after adjusting the distance between strings.

The operation of the bridge 42 will now be described with reference to FIGS. 8 and 9. An example in which the unit base 44 corresponding to the sixth string (i.e., the leftmost string 15 as viewed in FIG. 8) of the electric guitar 41 is pivoted will be described.

First, the first and second screws 26 and 27 are loosened to enable pivoting of the unit base 44 relative to the base plate 43. In this state, the saddle 45 is supported by the two support rods 30 and the adjustment screw 31 on the unit base 44. Thus, the second contact point C2 on the saddle 45 follows the movement of the unit base 44 in direction A. This moves the string 15 against its elastic reaction force in direction A. After arranging the second contact point C2 at the desired position (the position shown in the state of FIG. 9), the second screw 27 is tightened to fasten the unit base 44 to the base plate 43.

The second embodiment has the advantages described below.

(16) The through hole 12*b* for holding the ball end B of the corresponding string 15 is formed in the upper surface 12*a* of the body 12. In this case, in comparison with the first embodiment that includes the unit base 23 and the tailpiece 25, the tension of the string 15 is prevented from being directly applied to the bridge 42. Further, the structure of the unit base 44 is simplified.

(17) The support rods 30 are respectively fitted into the guide holes 48 of the unit base 44. This enables movement of the saddle 45 in the longitudinal direction of the string 15 by moving the saddle 45 along the guide holes 48. Further, the size of the saddle 45 may be reduced to miniaturize the bridge 42. Accordingly, the bridge 42 of this embodiment is advantageous especially in stringed instruments having many strings 15.

Third Embodiment

Figure 10:
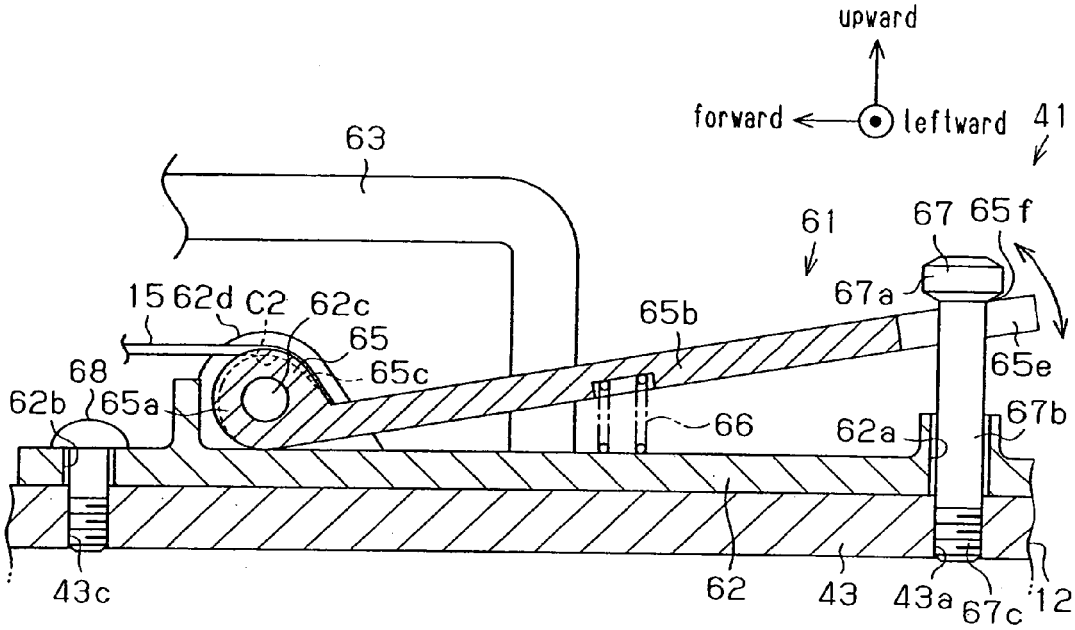
FIG. 10 is a cross-sectional view of a stringed instrument bridge according to a third embodiment of the present invention.

A stringed instrument bridge according to a third embodiment of the present invention and applied to an electric guitar including a tremolo device and a fine tuning means will now be described with reference to FIG. 10. Components that are the same as the corresponding components of the other embodiments will not be described in detail.

A bridge 61 includes a base plate 43 arranged on the body 12. The base plate 43 is supported by a hinge mechanism (not shown) on the body 12. A saddle holder 62, a saddle 65, and a tremolo arm 63 are arranged on the base plate 43. When the tremolo arm 63 is operated, the base plate 43 moves about the hinge mechanism and varies the tension applied to each string 15.

An insertion hole 62*a* is provided near the rear end of the saddle holder 62. The base plate 43 has a threaded hole 43*a* corresponding to the insertion hole 62*a*. A tuning bolt 67 is inserted through the insertion hole 62*a* of the saddle holder 62 and mated with the threaded hole 43*a* of the base plate 43. A further insertion hole 62*b* is provided near the front end of the saddle holder 62. The insertion hole 62*b* is an arcuate elongated hole that extends about the tuning bolt 67. The base plate 43 has a threaded hole 43*c* corresponding to the insertion hole 62*b*. A fastening screw 68 is inserted through the insertion hole 62*b* of the saddle holder 62 and mated with the threaded hole 43*c* of the base plate 43. When the fastening screw 68 is loosened, the saddle holder 62 becomes pivotal about the tuning bolt 67. When the fastening screw 68 is tightened, the front end portion of the saddle holder 62 is fastened to the base plate 43.

A saddle holding portion 62*d* is defined near the front end of the saddle holder 62. The saddle holding portion 62*d* includes a shaft 62*c* extending in the lateral direction. The shaft 62*c* supports the saddle 65 on the saddle holder 62. The saddle 65 includes a cylindrical saddle body 65*a* and a plate-shaped tuning lever 65*b*. The saddle body 65*a* is supported by the shaft 62*c*. Further, the tuning lever 65*b* extends rearward from the lower end of the saddle body 65*a*. In this embodiment, the tuning bolt 67 and the tuning lever 65*b* form a fine tuning means for finely adjusting the tension applied to the string 15 without changing the height of the string 15 from the base plate 43 or the length of the string 15 between the first and second contact points C1 and C2.

A recess 65*c* is formed in the middle portion of the saddle body 65*a*. The contact point C2 at which the saddle body 65*a* contacts the string 15 is defined in the recess 65*c*. A compression coil spring 66 is arranged between the saddle holder 62 and the tuning lever 65*b*. The compression coil spring 66 urges the tuning lever 65*b* in the upward direction.

A slit 65*e* is formed in the rear end portion of the tuning lever 65*b*. The tuning bolt 67 includes a head 67*a* and a shaft 67*b*. A male threaded portion is defined on a distal portion 67*c* of the shaft 67*b*. The tuning bolt 67 is arranged in the slit 65*e* of the tuning lever 65*b* and mated with the threaded hole 43*a* of the base plate 43. The urging force of the compression coil spring 66 pushes the upper surface 65*f* of the tuning lever 65*b* against the head 67*a* of the tuning bolt 67. The rear end portion of the tuning lever 65*b* is moved in the vertical direction by changing the mating amount of the tuning bolt 67. This pivots the saddle body 65*a* about the shaft 62*c*.

The operation of the third embodiment will now be discussed with reference to FIG. 10.

First, the fastening screw 68 is loosened to enable the saddle holder 62 to be pivoted along the upper surface of the base plate 43. In this case, the second contact point C2 of the saddle holder 62 is moved in the lateral direction to adjust the distance between adjacent strings 15. Then, the fastening screw 68 is tightened to fasten the saddle holder 62 to the base plate 43.

When increasing the mating amount of the tuning bolt 67, the head of the tuning bolt 67 is moved downward. The head 67*a* of the tuning bolt 67 forces the tuning lever 65*b* downward and pivots the saddle body 65*a* about the shaft 62*c*. In this case, the contact point C2 of the saddle holder 62 is not moved in the vertical direction and in the longitudinal direction of the corresponding string 15. In this manner, the operation of the tuning bolt 67 raises the tension applied to the string 15. Further, the tension applied to the string 15 may be lowered by decreasing the mating amount of the tuning bolt 67. Accordingly, the stringed instrument bridge 61 of the present invention may be applied to an electric guitar including a tremolo device or a fine tuning device.

Fourth Embodiment

A stringed instrument bridge according to a fourth embodiment of the present invention and applied to an electric guitar will now be described with reference to FIG. 11. The fourth embodiment differs from the first embodiment in the positional relationship between the first screw 26, the saddle 24, and the second screw 27. Components that are the same as the corresponding components of the first embodiment will not be described in detail.

Figure 11:
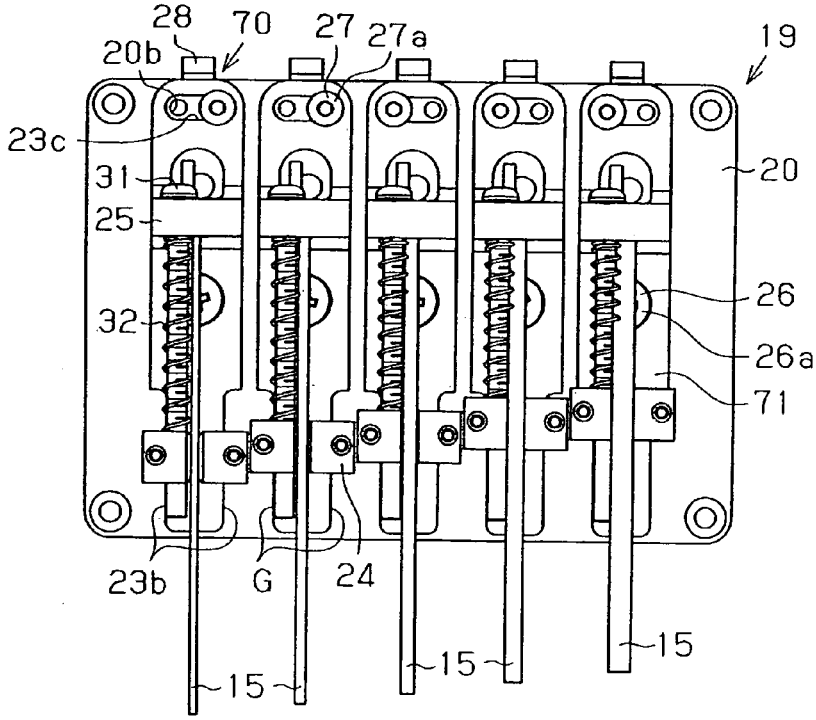
FIG. 11 is a plan view showing a stringed instrument bridge according to a fourth embodiment of the present invention.

Referring to FIG. 11, the bridge 19 includes a plurality of saddle units 70 arranged on the base plate 20. Each saddle unit 70 includes a unit base 71 having a front portion defining a guide 23*b*. The tailpiece 25 is formed rearward from the middle of the unit base 71. A tab 28 is formed on the rear end of the unit base 71. An elongated hole 23*c* is formed in the unit base 71 between the tab 28 and the tailpiece 25. In this embodiment, the string 15 is not strung above the second screw 27 and the tab 28. Accordingly, when loosening the second screw 27 with a tool, the tool does not interfere with the string 15. Further, when holding the tab 28 with one's fingers, one's fingers do not interfere with the string 15.

It should be apparent to those skilled in the art that the present invention may be embodied in many other specific forms without departing from the spirit or scope of the invention. Particularly, it should be understood that the present invention may be embodied in the following forms.

In the first embodiment, the tailpiece 25, which functions as a string holder, may be separate from the bridge 19. In the second embodiment, a tailpiece 25 may be arranged rearward from the bridge 42.

Figure 12:
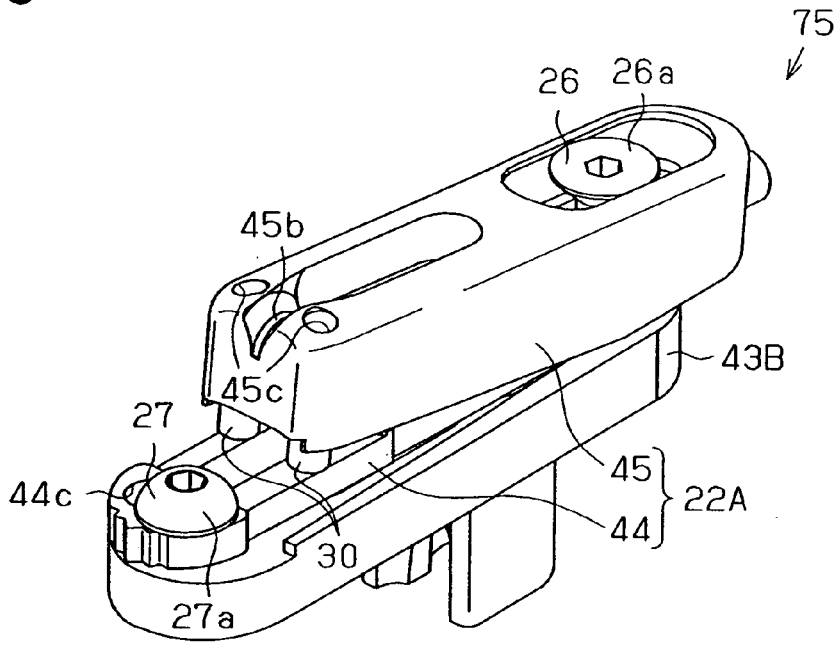
FIG. 12 is a perspective view showing a stringed instrument bridge in a modification of the present invention.

A bridge 75, which is shown in FIG. 12, may be employed in the first to fourth embodiments. In this case, a base plate 43B is arranged in correspondence with each saddle unit 22A.

In the first and second embodiments, the mechanism for adjusting the height of each string 15 may be eliminated. In the third embodiment, a mechanism for adjusting the height of each string 15 may be provided.

In the first and second embodiments, the mechanism for adjusting the length of each string 15 may be eliminated. In the third embodiment, a mechanism for adjusting the length of each string 15 may be provided.

In the first embodiment, the unit base 23 and saddle 24 shown in FIG. 3 may be formed integrally with each other. In the second embodiment, the unit base 44 and saddle 45 shown in FIG. 7 may be formed integrally with each other.

In the first to fourth embodiments, members other than a screw may be used as the first screw 26.

In the first to fourth embodiments, the fastening position of the first screw 26 may be changed to the middle portion of the unit base 23.

In the first to fourth embodiments, the base plates 20 and 43 may be eliminated, and the saddle units 22 and 22A may be directly fixed to the body 12.

In the first to fourth embodiments, the tab 48 may be eliminated.

Figure 13A:
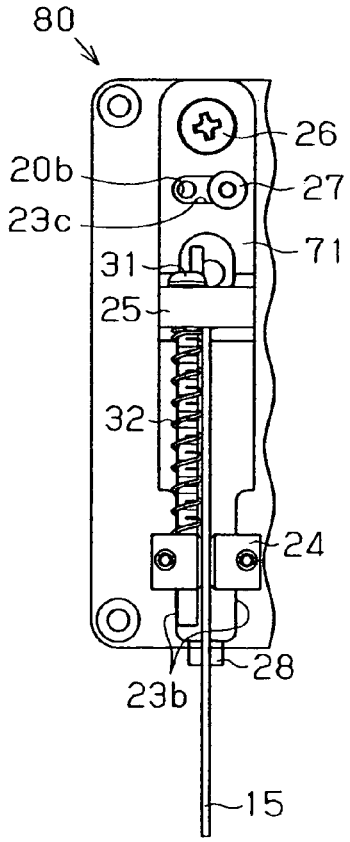
FIG. 13(A) is a plan view showing a saddle unit in another modification of the present invention.
Figure 13B:
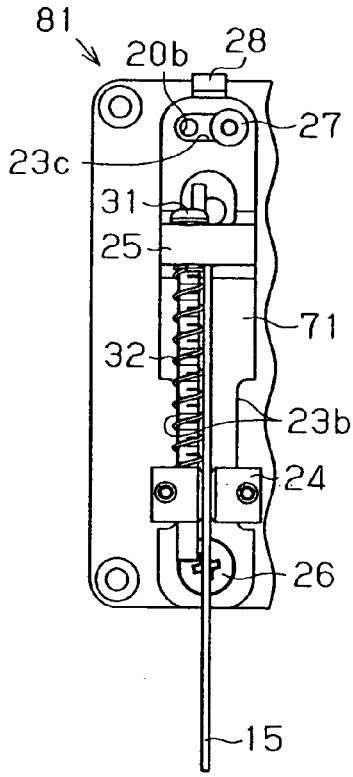
FIG. 13(B) is a plan view showing a saddle unit in a further modification of the present invention.
Figure 14:
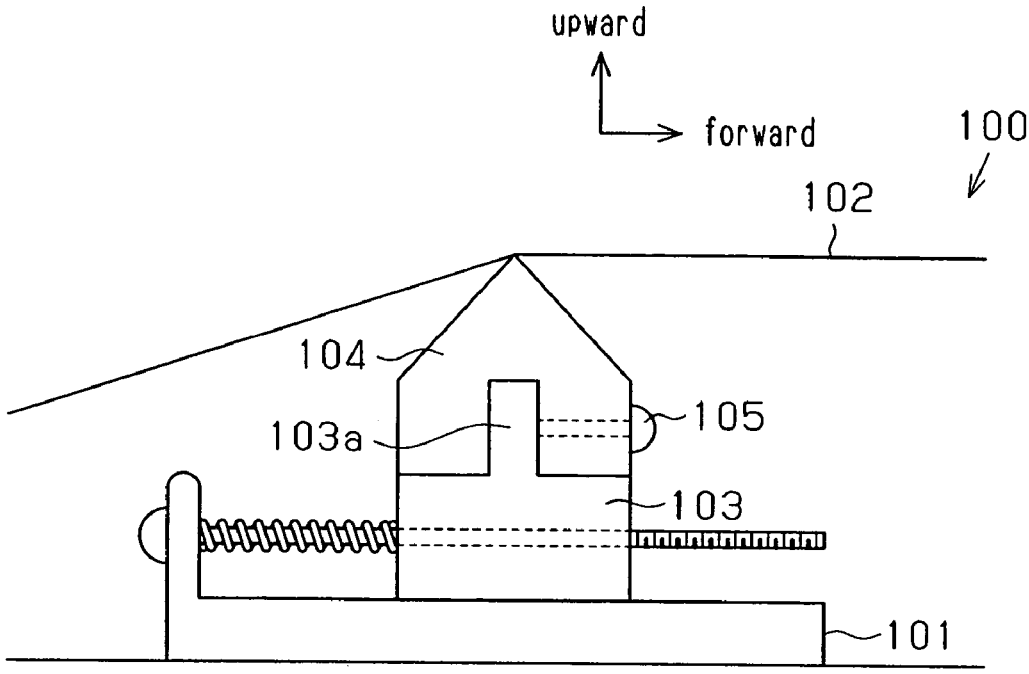
Fig.14 (Prior Art)
FIG. 14 is a schematic side view showing a stringed instrument bridge of the prior art.

In the first embodiment, the positional relationship of the saddle 24, the second screw 27, and the first screw 26 may be changed as shown in FIG. 13(A) or FIG. 13(B). FIG. 13(A) shows a saddle unit 80. The first screw 26, the second screw 27, and the saddle 24 are arranged in this order from the rear end to the front end of the saddle unit 80. FIG. 13(B) shows a saddle unit 80. The second screw 27, the saddle 24, and the first screw 26 are arranged in this order from the rear end to the front end of the saddle unit 81.

In the first, second, and fourth embodiments, the second screw 27, the elongated hole 23*c*, and the threaded hole 20*b* may be eliminated. Instead, an engaging portion and an engaged portion may be formed near the front end of the unit base and the base plate. In this case, the engaging portion and the engaged portion are engaged with each other to fasten the unit base to the base plate.

In the first to fourth embodiments, the electric guitar and the bass guitar may be changed to other stringed instruments. Further, the stringed instrument may have any number of strings 15.

The present examples and embodiments are to be considered as illustrative and not restrictive, and the invention is not to be limited to the details given herein, but may be modified within the scope and equivalence of the appended claims.

The invention claimed is:

1. A stringed instrument bridge for supporting, on a body of a stringed instrument, a plurality of strings in a manner enabling vibration of the strings, the stringed instrument bridge comprising:

a base plate mountable to the body of the instrument;

a plurality of unit bases arrangeable on the base plate, each unit base corresponding to one of the strings;

a saddle arranged on each unit base and having a contact point for contacting the string; and a support shaft for each unit base, anchored to the base plate and pivotally supporting each unit base on the base plate, wherein the unit base is pivoted about the support shaft to move the contact point along the face of the base plate in a direction intersecting the corresponding string.

2. The stringed instrument bridge according to claim 1, further comprising:

a fastener for fastening each unit base to the body at a position separated from the support shaft.

3. The stringed instrument bridge according to claim 2, wherein the fastener is a screw, and the support shaft is located closer to the saddle than the screw.

4. The stringed instrument bridge according to claim 2, wherein the stringed instrument includes:

a neck extending from the body; and a nut for supporting the strings on the neck in a manner enabling vibration of the strings, the saddle being located closer to the nut than the support shaft.

5. The stringed instrument bridge according to claim 3, wherein the screw is arranged closer to the nut relative to the support shaft.

6. The stringed instrument bridge according to claim 2, wherein each unit base includes a tab for a person to hold with his or her fingers.

7. The stringed instrument bridge according to claim 6, wherein the support shaft is closer to the saddle than the tab.

8. The stringed instrument bridge according to claim 2, wherein each unit base includes an end portion, and the support shaft is located on the end portion.

9. The stringed instrument bridge according to claim 3, wherein each unit base includes an arcuate elongated hole extending about the support shaft, with the screw being inserted into the elongated hole.

10. The stringed instrument bridge according to claim 1, wherein each unit base includes a string holder for holding the corresponding string.

11. The stringed instrument bridge according to claim 1, wherein each string has an end portion held by the body and is supported by the corresponding saddle in a manner enabling vibration.

12. The stringed instrument bridge according to claim 1, wherein the saddle includes a string holder for holding the corresponding string.

13. The stringed instrument bridge according to claim 1, wherein each unit base includes a guide for guiding the corresponding saddle along the corresponding string.

14. The stringed instrument bridge according to claim 1, wherein the saddle is supported in a manner enabling the saddle to move toward and away from the corresponding unit base.

15. The stringed instrument bridge according to claim 1, further comprising:

a tuning means for moving each unit base toward and away from the body.

16. A stringed instrument for producing music, the stringed instrument comprising:

a body, a neck extending from the body, a head located on a distal end of the neck, and a plurality of strings, each having a basal end fixed to the body and a distal end fixed to the head;

a stringed instrument bridge for supporting, on the body of a stringed instrument, the strings in a manner enabling vibration of the strings, the stringed instrument bridge including:

a base plate mountable to the body of the instrument;

a plurality of unit bases arrangeable on the base plate, each unit base corresponding to one of the strings;

a saddle arranged on each unit base and having a contact point for contacting the string; and a support shaft for each unit base, anchored to the base plate and pivotally supporting each unit base on the base plate, wherein the unit base is pivoted about the support shaft to move the contact point along the face of the base plate in a direction intersecting the corresponding string.

17. The stringed instrument according to claim 16, further comprising:

a tremolo device enabling a variable tension to be applied to the strings.

* * * * *